US011371189B2

(12) United States Patent
Grundl et al.

(10) Patent No.: US 11,371,189 B2
(45) Date of Patent: Jun. 28, 2022

(54) HEAT-SEALABLE BARRIER PAPER

(71) Applicant: Mitsubishi HiTec Paper Europe GmbH, Bielefeld (DE)

(72) Inventors: Lena-Maria Grundl, Flensburg (DE); Nadia El-Karzazi, Bielefeld (DE); Dieter Becker, Georgsmarienhütte (DE); Konstantinos Kalessios, Frankfurt am Main (DE); Jochen Schlegel, Heroldsberg (DE)

(73) Assignee: MITSUBISHI HITEC PAPER EUROPE GMBH, Bielefeld (DE)

( * ) Notice: Subject to any disclaimer, the term of this patent is extended or adjusted under 35 U.S.C. 154(b) by 0 days.

(21) Appl. No.: 16/969,241

(22) PCT Filed: Feb. 13, 2019

(86) PCT No.: PCT/EP2019/053517
§ 371 (c)(1),
(2) Date: Aug. 12, 2020

(87) PCT Pub. No.: WO2019/158566
PCT Pub. Date: Aug. 22, 2019

(65) Prior Publication Data

US 2021/0002828 A1 Jan. 7, 2021

(30) Foreign Application Priority Data

| | | |
|---|---|---|
| Feb. 13, 2018 | (DE) | 10 2018 103 206.4 |
| Jun. 8, 2018 | (DE) | 10 2018 113 695.1 |
| Feb. 11, 2019 | (DE) | 10 2019 103 343.8 |

(51) Int. Cl.

| | |
|---|---|
| ***D21H 19/18*** | (2006.01) |
| ***D21H 19/20*** | (2006.01) |
| ***D21H 19/34*** | (2006.01) |
| ***D21H 19/82*** | (2006.01) |
| ***D21H 25/02*** | (2006.01) |
| ***D21H 27/10*** | (2006.01) |

(52) U.S. Cl.
CPC ..... *D21H 19/18* (2013.01); *D21H 19/20* (2013.01); *D21H 19/34* (2013.01); *D21H 19/824* (2013.01); *D21H 25/02* (2013.01); *D21H 27/10* (2013.01)

(58) Field of Classification Search
USPC ..... 162/172
See application file for complete search history.

(56) References Cited

U.S. PATENT DOCUMENTS

| | | | | |
|---|---|---|---|---|
| 8,557,033 | B2 | 10/2013 | Gröndahl et al. | |
| 2007/0087190 | A1 | 4/2007 | Akiyama et al. | |
| 2008/0249233 | A1 | 10/2008 | Haner et al. | |
| 2012/0114916 | A1 | 5/2012 | Anderson et al. | |
| 2012/0276596 | A1 | 11/2012 | Pere et al. | |
| 2019/0194872 | A1* | 6/2019 | Becker | D21H 19/42 |

FOREIGN PATENT DOCUMENTS

| | | |
|---|---|---|
| AU | 2004262724 | 2/2005 |
| CN | 1708382 | 12/2005 |
| CN | 102753757 | 10/2012 |
| DE | 212012000194 U1 | 6/2014 |
| DE | 102014119572 | 6/2016 |
| EP | 2371919 | 10/2005 |
| EP | 3342929 | 7/2018 |
| GB | 2343196 | 5/2000 |
| GB | 2418380 | 3/2006 |
| WO | WO 2012/061800 | 5/2012 |
| WO | WO 2013066246 | 5/2013 |
| WO | WO 2013075918 | 5/2013 |

OTHER PUBLICATIONS

Office Action of the corresponding German Patent Application No. 10 2018 103 206.4.
Office Action dated Jan. 6, 2022 issued in Chinese Patent Application No. 201980012960.0.

* cited by examiner

*Primary Examiner* — Mark Halpern
(74) *Attorney, Agent, or Firm* — Cozen O'Conner

(57) ABSTRACT

A heat-sealable barrier paper having a) a carrier substrate having a front side and a back side opposite the front side, b) optionally an interlayer comprising a binder and disposed on the front side of the carrier substrate, c) a first barrier layer comprising a crosslinked polysaccharide and disposed on the front side of the carrier substrate or, if there is an interlayer, on the interlayer, d) a second barrier layer, disposed on the first barrier layer and consisting of or comprising i) an acrylate copolymer and/or ii) a wax based on a vegetable oil, the use of a barrier paper for packaging products, a method for heat-sealing a barrier paper, and to a method for producing a barrier paper.

20 Claims, No Drawings

HEAT-SEALABLE BARRIER PAPER

CROSS REFERENCE TO RELATED APPLICATIONS

This is a U.S. national stage of Application No. PCT/EP2019/053517 filed Feb. 13, 2019. Priority is claimed on German Application No. DE 10 2018 103 206.4 filed Feb. 13, 2018, German Application No. DE 10 2018 113 695.1 filed Jun. 8, 2018 and German Application No. DE 10 2019 103 343.8 filed Feb. 11, 2019 the contents of which are incorporated herein by reference.

BACKGROUND OF THE INVENTION

1. Field of the Invention

The present invention relates to a heat-sealable barrier paper comprising or consisting of a) a carrier substrate having a front side and a back side opposite the front side, b) optionally an interlayer comprising a binder disposed on the front side of the carrier substrate, c) a first barrier layer comprising a crosslinked polysaccharide and disposed on the front side of the carrier substrate or, if there is an interlayer, on the interlayer, d) a second barrier layer, disposed on the first barrier layer and consisting of or comprising i) an acrylate copolymer and/or ii) a wax based on a vegetable oil. The present invention further relates to the use of a barrier paper for packaging products, to a method for heat-sealing a barrier paper of the invention, and to a method for producing a barrier paper.

2. Description of Related Art

Foods sold in loose form, such as sausage, cheese, or bakery products, are conventionally handed to customers in packaging, for reasons of hygiene or freshness retention. There are stringent requirements on the packaging in this case, especially for fatty foods. Where conventional, paper-based packaging is used, with fatty foods, the fat from the food may penetrate the packaging material. This may lead to the packaging material softening and tearing, or to contamination of other items by the fat if they come into contact with the packaging.

U.S. Pat. No. 8,557,033 B2 describes a film-binding composition which comprises a hemicellulose. The films produced are notable for effective resistance to liquids and to moisture.

DE 10 2014 119 572 Al describes a packaging paper for foods that has an areal density of between 20 g/m$^2$ and 40 g/m$^2$ and that has a mass fraction of filler of less than 20%, based on the mass of the uncoated paper. The packaging paper at least on one side has a coating that comprises a polymer-encapsulated vegetable oil, talc, and a binder.

Fatty foods are frequently packaged using a wood-free, fatproof "greaseproof" paper, which by virtue of wet beating of the fibrous materials has a certain fat resistance. Frequently, however, the fat resistance of these greaseproof papers is inadequate.

Wet beating is achieved by wide bars set widely apart or by basalt rock barring in conjunction with a long beating time. The fibers, rather than being shredded, are squeezed. This produces a highly swelling fiber mucilage, a slimy and greasy pulp which undergoes only slow dewatering on the paper machine. The paper acquires a high density, but loses opacity. It becomes glassily translucent. Where the extent of fiber shortening is low, the term "long wet" is used. Fibers shortened to a greater extent are referred to as "short wet". Where the substrate is made predominantly short wet fibers, its tear initiation resistance and tearing resistance are only low.

Frequently used as a more fat-resistant alternative to greaseproof paper is composite packaging. Composite packaging may consist, for example, of a composite formed from a paper and from a polymeric and/or aluminum foil. If no polyethylene coating (PE) takes place, fluorocarbons can be used as water-repellent chemicals. Paper here is coated for example on one side with polyethylene, frequently in an extrusion process, or with an aluminum foil. Composite packaging of this kind is notable for high fat resistance. This composite packaging, however, cannot easily be passed for paper recycling, since first it is necessary for the foil layer to be removed. Nor is it possible to compost these composites, because the polymeric or aluminum foils used do not biodegrade.

Moreover, the growing concern about the scarcity of fossil, nonrenewable resources, such as coal (for example, bituminous coal or lignite coal), petroleum or natural gas, has resulted in a steadily growing interest in the production of materials from renewable raw materials. Reference may be made in this context to, for example, polyethylene furanoate, a plastic based on 2,5-furandicarboxylic acid, or polylactic acid (PLA), a plastic based on lactic acid, the starting substances of which may be produced from sugars. It has emerged, however, that the existing polymers produced from renewable raw materials either are nonbiodegradable or do not have the properties needed for use in packaging materials.

By fossil raw materials are meant gaseous, liquid, and solid fuels that consist of organic substances and have been formed by a biomass conversion process that has been ongoing in particular since the Mesozoic. They consist predominantly of carbon and hydrogen, but also contain oxygen, nitrogen, and sulfur, and also mineral admixtures. The most important fossil raw materials are coal, petroleum, and natural gas.

Renewable raw materials are a subset of the renewable resources. By these are meant substances that originate from living matter and are used by humans specifically for purposes other than those of food and fodder.

The requirements imposed on the barrier paper, namely a high and/or defined resistance to penetration by fats, oils, water, and water vapor, and high reusability or biodegradability, are requirements that typically contradict one another. Within industry, therefore, there is a great demand to provide packaging paper for food that can be produced wholly or predominantly from renewable raw materials and at the same time can be effectively reused or biodegraded.

For the packing of the products it is desirable, moreover, if the barrier paper is heat-sealable—that is, if it can be joined to surfaces by exposure to heat and, optionally, pressure.

DETAILED DESCRIPTION OF THE INVENTION

It is an object of one aspect of the present invention to provide a packaging material that has low gas permeability, particularly with respect to water vapor and/or oxygen. It is a further object of one aspect of the present invention to configure the packaging material in such a way that it is suitable for contact with foods and in that case has a high resistance and barrier effect toward fats and/or oils and/or water or water vapor. A further object of one aspect of the present invention is to configure the packaging material in such a way that it can be produced wholly or predominantly from renewable raw materials. An additional object of one aspect of the present invention is to design the barrier paper such that it has a heat-sealable configuration. It is desirable, additionally, if the barrier paper can readily be recycled and/or biodegraded, i.e., composted.

These objects are achieved in accordance with one aspect of the invention by a heat-sealable barrier paper comprising or consisting of a) a carrier substrate having a front side and a back side opposite the front side,
b) optionally an interlayer comprising a binder and disposed on the front side of the carrier substrate,
c) a first barrier layer comprising a crosslinked polysaccharide and disposed on the front side of the carrier substrate or, if there is an interlayer, on the interlayer,
d) a second barrier layer, disposed on the first barrier layer and consisting of or comprising
   i) an acrylate copolymer
   and/or
   ii) a wax based on a vegetable oil.

Surprisingly it has emerged in our own investigations that the combination of a first barrier layer, comprising a crosslinked polysaccharide, and a second barrier layer, consisting of or comprising an acrylate copolymer, a wax based on a vegetable oil, or a mixture of acrylate copolymer and a wax based on a vegetable oil, exhibit particularly low gas permeability, especially with respect to water vapor and oxygen, and also, moreover, exhibits a particularly good barrier effect with respect to fats, oils, and water. Our own investigations here have shown that the combination of the first and second barrier layers exhibits a synergistic barrier effect which is attributable not only to the presence of two layers and/or the resulting thickness of the two layers.

In barrier papers of one aspect of the invention it is possible to do entirely without the use of extruded films, or to do entirely without metal foils applied by vapor deposition or adhesive bonding, because the individual layers of the barrier paper of one aspect of the invention can be produced by the application of dispersions. The individual layers of the barrier paper of one aspect of the invention are not extruded.

In the context of one aspect of this invention, a wax based on a vegetable oil is understood to mean a wax which is obtained by chemical modification of a vegetable oil. The chemical modification may, for example, be a partial or complete hydrogenation with a metallic catalyst, for example nickel, and hydrogen, wherein all or some of the double bonds in the oil are hydrogenated to single bonds. Unlike vegetable oils, waxes are not in liquid form but in solid form at 20° C. The effect of the chemical modification of the vegetable oil is thus an increase in the melting point.

A vegetable oil is understood to mean a fatty acid triglyceride that is obtained from plants or plant parts. The oil is typically obtained by pressing, extraction or refining of the oils from the plants or plant parts. The obtaining of the oils is known to the person skilled in the art. If plant seeds are used for obtaining oil, these are referred to as oilseeds. The oil in the seeds is in the form of lipids that constitute the cell membrane and energy reserves thereof. Depending on the proportion of unsaturated fatty acids in the oil, a distinction is made between nondrying oils (for example olive oil), semidrying oils (for example soybean oil or rapeseed oil) and drying oils (for example linseed oil or poppyseed oil). The term "drying" here does not mean evaporation, but rather the solidification of the oil caused by oxidation and polymerization of the unsaturated fatty acids. Preference is given to the use of semidrying and drying oils as starting material for production of the waxes used in accordance with one aspect of the invention.

Possible sources for vegetable oil are açai oil, algae oil, argan oil (from the fruit of the argan tree), avocado oil (from the fruit flesh of the avocado from the avocado tree), babaçu oil, cottonseed oil (from the seeds of the cotton plant), borage oil or borageseed oil (from the seeds of the borage plant), cupuaçu butter, cashewshell oil, safflower oil (from the seeds of the safflower or carthamus), peanut oil (from the fruit of the peanut plant), hazelnut oil (from hazelnuts from the hazelnut bush), hemp oil (from the seeds of edible hemp), jatropha oil (from the seeds of *Jatropha curcas*), jojoba oil (actually a liquid wax; from the seeds of the jojoba bush), camellia oil (from the seeds of *Camellia oleifera, Camellia sinensis* or *Camellia japonica*), cocoa butter, coconut oil (from the seed flesh of the coconut, the tree fruit of the coconut palm), pumpkinseed oil (also referred to as seed oil; from the seed kernels of the Styrian oil pumpkin), linseed oil (from ripe linseeds from flax), false flax oil (from the seed of the false flax, Brassicaceae family), macadamia oil (from the nuts of the macadamia tree), maize kernel oil (from the kernels of maize), almond oil (from almonds from the almond tree), mango butter (from *Mangifera indica*), apricot kernel oil (from the apricot kernel—i.e., the almond of the apricot stone—the apricot), poppyseed oil (from the seed grains of the poppy), evening primrose oil, olive oil (from the fruit flesh and core of the olive, the fruit of the olive tree), palm oil (from the fruit flesh of the palm fruit, the fruit of the oil palm), palm kernel oil (from the kernels of the palm fruit, the fruit of the oil palm), papaya oil, pistachio oil, pecan nut oil, perilla oil from the seeds of the perilla plant (shiso, sesame leaf), rapeseed oil (from the seeds of rape, Brassicaceae family), rice oil, castor oil (from the seeds of the castor oil plant), sea buckthorn oil (from the fruit flesh of the sea buckthorn berry, the fruit of the sea buckthorn bush), sea buckthorn kernel oil (from the kernels of the sea buckthorn berry, the fruit of the sea buckthorn bush), mustard oil (from the seed kernels of black mustard), black cumin oil (from the seeds of the fruit capsule of the black cumin plant), sesame oil (from the seeds of the sesame plant), shea butter (from the seeds of the shea nut tree), soya oil (from the beans of the soybean), sunflower oil (from the kernels of the sunflower), tung oil, walnut oil (from the kernels of the nuts from the walnut tree), watermelonseed oil, grapeseed oil (from the seeds of the fruits (grapes) of the grape plant or grapevine), wheat germ oil (from the germ of wheat) and/or cedar oil (from the wood of the Lebanon cedar). This list should not be regarded as conclusive; it shows ways of obtaining vegetable oils that can be converted to a wax used in accordance with one aspect of the invention.

Preference is given in accordance with one aspect of the invention to a barrier paper wherein the wax based on a vegetable oil is a wax based on an oil selected from the list encompassing palm oil, coconut oil, poppyseed oil, olive oil, linseed oil, soybean oil, sunflower oil, safflower oil, and rapeseed oil, the wax based on a vegetable oil preferably being a wax based on a soybean oil, i.e., soybean oil wax or soy wax.

Our own investigations have shown that waxes made from the oils specified as preferred above have particularly good properties. The waxes produced from these oils (especially soybean oil) are notable for high durability and can be produced with high melting points. The waxes used in accordance with one aspect of the invention, namely palm oil wax, coconut oil wax, poppyseed oil wax, olive oil wax, linseed oil wax, soybean oil wax, sunflower oil wax, safflower oil wax, and rapeseed oil wax, show a significant increase in resistance to fats and/or oils and/or moisture when used in barrier papers of the invention. In particular, the use of soybean oil wax is preferred in accordance with one aspect of the invention. Our own investigations have shown that, when soybean oil wax is used, not only the resistance to fat, oil, and moisture but also very low water vapor permeability can be obtained. Soybean oil wax additionally has the advantage that it can be produced in taste- and odor-neutral form.

Preference is given in accordance with one aspect of the invention to barrier papers wherein the wax has a melting point above 40° C., preferably above 50° C., more preferably above 60° C.

Our own investigations have shown that it is already possible to achieve very good results when waxes having a melting point above 20° C. are used. However, it has been found that, surprisingly, when waxes having a melting point above 40° C. are used, the resistance of the barrier papers to mechanical stress can be enhanced. This resistance is enhanced even further at even higher melting points of the waxes. Our own investigations have additionally shown that the optimal melting point of the waxes is in the range from 60 to 80° C. if the barrier papers are to be used at temperatures between 6° C. and 30° C. If the barrier papers are also to be employed at higher temperatures, it may be advisable to use a wax having a higher melting point.

Preference is given in accordance with the invention to barrier papers wherein the mass fraction of the wax in the second barrier layer is 6 to 98%, preferably 20 to 90%, more preferably 50 to 89%, based on the total mass of the barrier layer.

Our own investigations have shown that, surprisingly, there is a disproportionately significant decrease in fat, oil, and moisture barrier properties in the case of a wax mass fraction below 6%, whereas excellent barrier properties can be obtained in the case of a wax mass fraction above 98%, but there is a disproportionately significant decrease in the mechanical stability of the barrier layer. Our own investigations have shown that particularly good barrier papers with optimal barrier and mechanical properties can be obtained when the wax mass fraction is 50 to 89%.

Our own investigations have shown that it is advantageous for the second barrier layer to is comprise not only the wax but also a polymeric binder. Suitable polymeric binders which may be present as well as the wax in the second barrier layer are all binders that are customary in papermaking. Our own investigations, however, have shown that a suitable selection of the polymeric binder may significantly improve the mechanical properties of the barrier layer and/or the biodegradability of the barrier paper. Our own investigations have shown that it is advantageous and therefore preferred in accordance with one aspect of the invention if the polymeric binder that may be present as well as the wax in the second barrier layer is a crosslinked or noncrosslinked binder selected from the group consisting of starch, polyvinyl alcohol, carboxyl group-modified polyvinyl alcohol, ethylene-vinyl alcohol copolymer, a combination of polyvinyl alcohol and ethylene-vinyl alcohol copolymer, ethylene-vinyl acetate copolymer, silanol group-modified polyvinyl alcohol, diacetone-modified polyvinyl alcohol, modified polyethylene glycol, unmodified polyethylene glycol, α-isodecyl-ω-hydroxy-poly(oxy-1,2-ethanediyl), styrene-butadiene latex, styrene-acrylate polymers, acrylic copolymers and mixtures thereof.

In one particularly preferred aspect of the present invention, the second barrier layer consists of or the second barrier layer comprises an acrylate copolymer and a wax based on a vegetable oil.

Our own investigations have shown that barrier papers of one aspect of the invention have particularly high resistance to fat, oil, and moisture if the polymeric binder which may be present as well as the wax in the second barrier layer is one or more styrene-acrylate polymers or the binder comprises the latter.

It has emerged here that waxes based on a vegetable oil, and here especially wax based on soybean oil, interact particularly well with acrylate copolymers. Through the combination of the acrylate copolymer with a wax based on a vegetable oil it is possible to obtain improved properties in the barrier layer which cannot be obtained by a combination of an acrylate copolymer with other waxes. Without wishing to be tied to any particular theory, it is assumed that the waxes based on a vegetable oil are able to interact with the acrylate copolymers as a result of the high level of unsaturated fatty acids and the consequently high double-bond density. While further wax may be added, very good barrier properties are obtained if acrylate copolymers and waxes based on a vegetable oil are used in the barrier layer.

It is preferred here in accordance with one aspect of the invention if, in the second barrier layer, the mass fraction of the polymeric binder which is present as well as the wax in the second barrier layer is 94 to 2%, preferably 80 to 10%, more preferably 50 to 11%, based on the total mass of the second barrier layer.

Our own investigations have shown that an amount of polymeric binders which are present as well as the wax in the second barrier layer that is below a mass fraction of 2% leads to barrier papers wherein there is a disproportionately significant decrease in the mechanical stability of the second barrier layer. Where the amount of polymeric binders is above a mass fraction of 94%, the mechanical stability of the second barrier layer is indeed sufficiently high, though it has emerged that there is a disproportionately significant decrease in the barrier properties with respect to fat, oil, and moisture. Our own investigations here have shown that particularly good barrier papers having optimum barrier and mechanical properties can be obtained if the amount of polymeric binders is a mass fraction of 50 to 11%.

It is particularly preferred in accordance with one aspect of the invention here if the mass fraction of the polymeric binder in the second barrier layer is 94 to 2% and the mass fraction of the wax in the second barrier layer is 6 to 98%, and it is still further preferred if the mass fraction of the polymeric binder in the second barrier layer is 80 to 10% and the mass fraction of the wax in the second barrier layer is 80 to 90%, and it is preferred further still if the mass fraction of the polymeric binder in the barrier layer is 50 to 11% and the mass fraction of the wax in the second barrier layer is 50 to 89%.

Our own investigations have shown that it is particularly advantageous if the polymeric binder which may be present as well as the wax in the second barrier layer consists of two or more binders and at least one binder is an anionic binder. An anionic binder is understood here to mean a binder containing multiple negative charges that are stabilized by cations (e.g., metal cations or ammonium).

It is preferred here in accordance with one aspect of the invention if the glass transition temperature of the anionic binder as determined by differential scanning calorimetry (DSC) is less than or equal to 120° C. Our own investigations have shown that if the glass transition temperature is above 120° C., it is very difficult to produce the second barrier layer, and the barrier papers produced do not have such good properties as barrier papers of one aspect of the invention that have been produced using an anionic binder having a glass transition temperature of less than or equal to 120° C.

It is preferred here in accordance with one aspect of the invention if the anionic binder present as well as the wax in the second barrier layer is a copolymer.

Suitable anionic binders which are present as well as the wax in the second barrier layer are, for example, partly or fully deprotonated polyacrylic acid (or copolymers thereof, with acrylic esters, for example), partly or fully deprotonated polymethacrylic acid (or copolymers thereof, with methacrylic esters, for example), copolymers of polyacrylic esters (preferably methyl or ethyl esters), copolymers of polymethacrylic esters (preferably methyl or ethyl esters), or polyacrylamides or copolymers thereof.

It is preferred in accordance with one aspect of the invention if an aqueous solution or dispersion of the anionic binder, which is present as well as the wax in the second barrier layer, has a basic pH when present with a mass fraction of 10% in solution or dispersion in water, preferably in the range from 8 to 10%.

In order to determine the pH of the anionic binder, an aqueous solution or dispersion of the anionic binder can be prepared that has a mass fraction of 10%, and the pH can be determined by standard means.

In the context of the present invention, a polymeric binder is understood to mean a binder that has been synthesized by polycondensation from a multitude of molecules, and in which one or more kinds of atoms or atomic moieties (called repeat units) are strung together repeatingly and the number of repeat units per module is more than 25.

In the case of a preferred barrier paper of one aspect of the invention, the binder in the interlayer is starch or a synthetic polymer, preferably a binder selected from the group encompassing starch, styrene-butadiene latex, polyvinyl alcohol, carboxyl group-modified polyvinyl alcohol, ethylene-vinyl alcohol copolymer, silanol group-modified polyvinyl alcohol, acetoacetyl-modified polyvinyl alcohol, diacetone-modified polyvinyl alcohol, acrylate copolymer, and film-forming acrylic copolymer.

It is particularly preferred here in accordance with one aspect of the invention if the binder in the interlayer is a synthetic polymer based on acrylic ester (preferably methyl acrylate or ethyl acrylate), styrene, and acrylonitrile.

In one preferred embodiment of one aspect of the present invention, the second barrier layer comprises one or more polymers selected from the group consisting of acrylic acid-acrylamide copolymer (poly(acrylic acid-co-acrylamide)), acrylic acid-acrylic ester-acrylonitrile copolymer, acrylic acid ethyl ester-carboxylic acid copolymer, acrylic acid ethyl ester-acrylic acid copolymer, ethyl acrylate-carboxylic acid copolymer, ethyl acrylate-acrylic acid copolymer, polymethyl methacrylate, and alkali metal or alkaline earth metal salts (preferably sodium salts) of the aforesaid polymers. In this case it is preferred if the mass fraction of the respective polymer is 0.1 to 1.0%, preferably 0.10 to 0.30%, more preferably 0.14 to 0.20%, based on the solids content of the second barrier layer.

In one particularly preferred aspect of the present invention, the second barrier layer comprises an acrylic acid-acrylamide copolymer (poly(acrylic acid-co-acrylamide)) and/or an and alkali metal or alkaline earth metal salt of an acrylic acid-acrylamide copolymer (preferably the sodium salt of the acrylic acid-acrylamide copolymer). In this case it is preferred if the mass fraction of acrylic acid-acrylamide copolymer is 0.1 to 1.0%, preferably 0.10 to 0.30%, more preferably 0.14 to 0.20%, based on the solids content of the second barrier layer. With particular preference the acrylic acid-acrylamide copolymer is a random copolymer.

If barrier papers are folded, and especially in the case of two crosswise folds, there is a significant decrease in the fat resistance of the barrier paper in the fold region and more particularly in the intersection region of two or more folds, since the folding results in a decrease in the barrier effect of the barrier paper. Our own investigations have shown that, surprisingly, the addition of polymers selected from the group consisting of acrylic acid-acrylamic copolymer (poly (acrylic acid-co-acrylamide)), acrylic acid-acrylic ester-acrylonitrile copolymer, acrylic acid ethyl ester-carboxylic acid copolymer, acrylic acid ethyl ester-acrylic acid copolymer, ethyl acrylate-carboxylic acid copolymer, ethyl acrylate-acrylic acid copolymer, polymethyl methacrylate, and alkali metal or alkaline earth metal salts (preferably sodium salt) of the aforesaid polymers is able to improve significantly the fat resistance of a barrier paper of the invention in the fold region of the barrier paper. The fat resistance here is influenced positively by all of the polymers listed above, with the use of an acrylic acid-acrylamide copolymer or of the sodium salt of the acrylic acid-acrylamide copolymer leading to particularly good fat resistances in the fold region of the barrier paper.

A further aspect of the present invention relates to the use of one or more polymers for improving the fat resistance of a (barrier) paper (preferably of a barrier paper of the invention) in the fold region of the (barrier) paper, wherein the one or more polymers are selected from the group consisting of acrylic acid-acrylamic copolymer (poly(acrylic acid-co-acrylamide)), acrylic acid-acrylic ester-acrylonitrile copolymer, acrylic acid ethyl ester-carboxylic acid copolymer, acrylic acid ethyl ester-acrylic acid copolymer, ethyl acrylate-carboxylic acid copolymer, ethyl acrylate-acrylic acid copolymer, polymethyl methacrylate, and alkali metal or alkaline earth metal salts (preferably sodium salts) of the aforesaid polymers, preferably acrylic acid-acrylamide copolymer (poly(acrylic acid-co-acrylamide) and the sodium salt of the acrylic acid-acrylamide copolymer (poly (acrylic acid-co-acrylamide).

Preference is given to a barrier paper of one aspect of the invention wherein the interlayer comprises the binder and also a pigment, preferably an inorganic pigment, more preferably selected from the group encompassing natural or calcined aluminum silicate (especially natural or calcined kaolinite or natural or calcined kaolin), hydrated magnesium silicate (talc), aluminum hydroxide (especially boehmite), bentonite, calcium carbonate, and silicon dioxide (silica).

It is particularly preferred in accordance with one aspect of the invention if the pigment in the interlayer is lamellar. Our own investigations have shown that lamellar pigments further improves the barrier effect of the resultant barrier paper. It is assumed that lamellar pigments come to lie one above another in the interlayer and in so doing form individual pigment layers. The individual pigment layers of lamellar pigments are denser and/or have a higher barrier effect than, for example, spherical pigments.

It is especially preferred if lamellar pigments in the interlayer has a (preferably average) aspect ratio of 3 to 100, preferably of 5 to 95, especially preferably of 10 to 90. In one preferred embodiment the (preferably average) aspect ratio of the pigment is greater than 15. The aspect ratio (also called shape factor) is a quotient formed between the diameter and the thickness of the lamellar platelet of the inorganic pigment prior to mixing with the other components. An aspect ratio of 15 means that the diameter of the platelet is 15 times greater than the thickness of the platelet.

Preference is given to a barrier paper of one aspect of the invention wherein the interlayer comprises i) a mass fraction in the range from 50 to 90% of pigment, preferably 60 to 80% of pigment, more preferably 65 to 75% of pigment and ii) a mass fraction in the range from 10 to 50% of binder, preferably 20 to 40% of binder, more preferably 25 to 35% of binder, based in each case on the total mass of the interlayer.

In a likewise preferred embodiment of one aspect of the present invention, the second barrier layer consists of or the second barrier comprises an acrylate copolymer and a wax based on saturated hydrocarbons.

Preference is given in accordance with one aspect of the invention to barrier papers wherein the wax based on saturated hydrocarbons has a melting point above 40° C., preferably above 50° C., more preferably above 60° C.

Preference is given in accordance with one aspect of the invention to barrier papers wherein the wax based on saturated hydrocarbons comprises or consists of one, two, three or more than three alkanes selected from the group consisting of heneicosane, docosane, tricosane, tetracosane, pentacosane, hexacosane, heptacosane, octacosane, nonacosane, triacontane, hentriacontane, dotriacontane, tritriacontane, tetratriacontane, pentatriacontane, hexatriacontane, heptatriacontane, octatriacontane, and nonatriacontane, preferably selected from the group consisting of hexacosane, heptacosane, octacosane, nonacosane, and triacontane. Particular preference is given in accordance with one aspect of the invention to barrier papers wherein the wax based on saturated hydrocarbons is a wax based on octacosane.

More preferably in accordance with one aspect of the invention, the acrylate copolymer in the second barrier layer is a copolymer having an average molar mass in the range from 50 000 to 150 000 g/mol, preferably in the range from 80 000 to 130 000 g/mol, more preferably in the range from 90 000 to 100 000 g/mol. The average molar mass is determined here with the aid of gel permeation chromatography (GPC) with tetrahydrofuran (THF; tetramethylene oxide; 1,4-epoxybutane; oxacyclopentane) as solvent, polystyrene as standard, and detection by RI detector (refractive index detector).

More preferably in accordance with one aspect of the invention, the acrylate copolymer in the second barrier layer is a copolymer prepared using two, three, four, five, six or all monomers selected from the group consisting of methyl acrylate, methyl methacrylate, butyl acrylate, butyl methacrylate, 2-ethylhexyl acrylate, 2-ethylhexyl methacrylate, and styrene.

Through a selection of the monomers used for preparation of the acrylate copolymer, it is possible to optimize the properties of the resulting acrylate copolymer. Our own investigations have surprisingly shown that an acrylate copolymer that has been prepared from methyl acrylate, methyl methacrylate, butyl acrylate, butyl methacrylate, 2-ethylhexyl acrylate, 2-ethylhexyl methacrylate and/or styrene has particularly good barrier properties.

As well as methyl acrylate, methyl methacrylate, butyl acrylate, butyl methacrylate, 2-ethylhexyl acrylate, 2-ethylhexyl methacrylate, and styrene, further monomers may have been used here for preparation of the acrylate copolymer, or the copolymer has been prepared from two, three, four, five, six or all monomers selected from the group consisting of methyl acrylate, methyl methacrylate, butyl acrylate, butyl methacrylate, 2-ethylhexyl acrylate, 2-ethylhexyl methacrylate, and styrene.

More preferably in accordance with one aspect of the invention, the acrylate copolymer is a random copolymer.

Preferred in accordance with one aspect of the invention is a barrier paper wherein, if there is no interlayer disposed on the front side of the carrier substrate, the second barrier layer i) comprises an acrylate copolymer and ii) a wax based on a vegetable oil, and, if there is no interlayer disposed on the front side of the carrier substrate, the second barrier layer comprises i) an acrylate copolymer or ii) a wax based on a vegetable oil.

Particularly preferred in accordance with one aspect of the invention is a heat-sealable barrier paper comprising or consisting of a) a carrier substrate having a front side and a back side opposite the front side, b) optionally an interlayer comprising a binder and disposed on the front side of the carrier substrate, c) a first barrier layer comprising a crosslinked polysaccharide and disposed on the front side of the carrier substrate or, if there is an interlayer, on the interlayer, d) a second barrier layer, disposed on the first barrier layer and consisting of or comprising i) an acrylate copolymer having an average molar mass in the range from 50 000 to 150 000 g/mol, wherein the acrylate copolymer has been prepared from two, three, four, five, six or seven monomers selected from the group consisting of methyl acrylate, methyl methacrylate, butyl acrylate, butyl methacrylate, 2-ethylhexyl acrylate, 2-ethylhexyl methacrylate, and styrene, and ii) a wax based on saturated hydrocarbons, wherein the wax based on saturated hydrocarbons is octacosane or wherein the wax based on saturated hydrocarbons comprises octacosane.

In a likewise preferred embodiment of the present invention, the second barrier layer consists of or the second barrier layer comprises an acrylate copolymer and a wax based on saturated hydrocarbons and a wax based on a vegetable oil.

Likewise particularly preferred in accordance with one aspect of the invention is a heat-sealable barrier paper comprising or consisting of a) a carrier substrate having a front side and a back side opposite the front side, b) optionally an interlayer comprising a binder and disposed on the front side of the carrier substrate, c) a first barrier layer comprising a crosslinked polysaccharide and disposed on the front side of the carrier substrate or, if there is an interlayer, on the interlayer, d) a second barrier layer, disposed on the first barrier layer and consisting of or comprising i) an acrylate copolymer having an average molar mass in the range from 50 000 to 150 000 g/mol, wherein the acrylate copolymer has been prepared from two, three, four, five, six or seven monomers selected from the group consisting of methyl acrylate, methyl methacrylate, butyl acrylate, butyl methacrylate, 2-ethylhexyl acrylate, 2-ethylhexyl methacrylate, and styrene, and ii) a wax based on saturated hydrocarbons, wherein the wax based on saturated hydrocarbons is octacosane or wherein the wax based on saturated hydrocarbons comprises octacosane, and iii) a wax based on a vegetable oil.

Likewise particularly preferred in accordance with one aspect of the invention is a heat-sealable barrier paper comprising or consisting of a) a carrier substrate having a front side and a back side opposite the front side, b) optionally an interlayer comprising a binder and disposed on the front side of the carrier substrate, c) a first barrier layer comprising a crosslinked polysaccharide and disposed on the front side of the carrier substrate or, if there is an interlayer, on the interlayer, d) a second barrier layer, which is disposed on the first barrier layer and consists of or comprises an acrylic acid-acrylamide copolymer and/or the sodium salt of an acrylic acid-acrylamide copolymer (preferably having a mass fraction of acrylic acid-acrylamide copolymer of 0.1 to 1.0%, preferably of 0.10 to 0.30%, more preferably of 0.14 to 0.20%, based on the solids content of the second barrier layer), and also one, two or all of components i) to iii).

i) an acrylate copolymer having an average molar mass in the range from 50 000 to 150 000 g/mol, wherein the acrylate copolymer has been prepared from two, three, four, five, six or seven monomers selected from the group consisting of methyl acrylate, methyl methacrylate, butyl acrylate, butyl methacrylate, 2-ethylhexyl acrylate, 2-ethylhexyl methacrylate, and styrene, ii) a wax based on saturated hydrocarbons, wherein the wax based on saturated hydrocarbons is octacosane or wherein the wax based on saturated hydrocarbons comprises octacosane, iii) a wax based on a vegetable oil.

In one embodiment of the barrier paper of one aspect of the invention the carrier substrate is a paper, cardboard or paperboard substrate. In the context of one aspect of invention, paper, cardboard, and paperboard are sheetlike materials which can be produced from the same base substances by in principle the same modes of fabrication. In the context of one aspect of invention, a distinction is made between paper, cardboard, and paperboard only on the basis of the areal density, with paperboard having a grammage of greater than 600 g/m$^2$, cardboard a grammage of greater than 150 and less than or equal to 600 g/m$^2$, and paper a grammage of less than or equal to 150 g/m$^2$. Irrespective of whether the carrier substrate used is paper, cardboard or paperboard, the resulting product of the invention is referred to in the context of the present invention as barrier paper, without any intended restriction thereby in terms of the grammage. In the context of one aspect of the present invention, therefore, the term "barrier paper" also encompasses the terms "barrier cardboard" and "barrier paperboard", unless there is any particularization of the grammage.

Preference is given to a barrier paper of one aspect of the invention wherein the carrier substrate comprises a pulp having a Schopper-Riegler freeness in the range from 24 to 54° SR, preferably in the range from 29 to 49° SR, more preferably in the range from 34 to 44° SR.

Preference is given to a barrier paper of one aspect of the invention wherein the carrier substrate comprises or consists of a pulp which comprises a short-fiber pulp and a long-fiber pulp. The ratio in this case between short-fiber pulp and long-fiber pulp is preferably in the range from 2:1 to 1:2, more preferably in the range from 1.5:1 to 1:1.5, very preferably of around 1:1.

In our own investigations it has emerged that the combination of a short-fiber pulp and a long-fiber pulp with the Schopper-Riegler freeness used in accordance with the invention leads to a particularly dense paper which has a very high barrier effect with respect to fat. This barrier effect can be improved still further if the Schopper-Riegler freeness is within the ranges identified as being preferable or more preferable, and/or if it has the values identified as being is preferable or more preferable.

In one embodiment, the barrier paper of one aspect of the invention is a barrier paper wherein the short-fiber pulp consists wholly or partly, preferably at least to a mass fraction of more than 50%, based on the total mass of the short-fiber pulp, of fibers from hardwoods, preferably of birch fibers, beech fibers or eucalyptus fibers, and the long-fiber pulp consists wholly or partly, preferably at least to an extent of more than 50%, based on the total mass of the long-fiber pulp, of fibers from softwoods, preferably of pine fibers, spruce fibers or fir fibers.

Our own investigations have shown that particularly good properties are obtained in the resultant barrier paper if the carrier substrate is produced from a mixture of a short-fiber pulp and a long-fiber pulp and if this mixture, before the carrier substrate is produced, is leveled once again in order to obtain the desired Schopper-Riegler freeness in the range from 24 to 54° SR, preferably in the range from 29 to 49° SR, more preferably in the range from 34 to 44° SR. The short-fiber and long-fiber pulps used prior to beating may have a Schopper-Riegler freeness which lies outside the preferred range, and the Schopper-Riegler freenesses of the short-fiber pulps and long-fiber pulps used are preferably smaller before beating than after beating.

Preference is given to a barrier paper of one aspect of the invention wherein the crosslinked polysaccharide is a crosslinked xylan or comprises a crosslinked xylan, preferably is a crosslinked arabinoxylan or comprises a crosslinked arabinoxylan.

Especially preferred in accordance with one aspect of the invention here is a barrier paper wherein the xylan is a xylan from wheat spelts or barley spelts. Although xylans from other plant sources are likewise highly suitable, our own investigations have shown that xylans from wheat spelts or barley spelts, when used in the first barrier layer, exhibit a particularly good barrier effect with respect to oxygen.

Preference is given to a barrier paper of the invention wherein the crosslinked polysaccharide is a mixture of crosslinked starch and crosslinked xylan. It is especially preferred here if a mixture of starch and xylan (preferably arabinoxylan) is crosslinked, so that there is also crosslinking between starch molecules and xylan molecules. In that case it is preferable if more starch than xylan is used; in other words, the starch fraction in the first barrier layer is higher than the xylan fraction. When considering the starch fraction and the xylan fraction, the reference point is the respective mass fractions prior to crosslinking. Where appropriate—if the fractions have to be determined in the case of a crosslinked product already—the fractions originally present are calculated correspondingly from the fraction of D-glucose and D-xylose determined—which can be determined, for example, by means of NMR.

In this context, our own investigations have shown that barrier papers that comprise a first and a second second barrier layer have particularly good properties if the polysaccharide is present in crosslinked form in the first barrier layer. Where polysaccharides are used in the first barrier layer that have not undergone crosslinking, there is partial or complete dissolution of the first barrier layer when the second barrier layer is applied. After the partial or complete dissolution of the first barrier layer and/or of the polysaccharides in the first barrier layer, the polysaccharides become mixed with the components of the second barrier layer. As a result, barrier papers are obtained which have no distinct first and second barrier layers and exhibit poorer barrier properties (especially in relation to the barrier effect toward gases, especially oxygen).

Preferred in accordance with one aspect of the invention are barrier papers wherein the polysaccharide has been crosslinked with a crosslinking agent selected from the group consisting of zirconium carbonate, polyamidamine-epichlorohydrin resins, boric acid, ammonium zirconium carbonate, methacrylate polymer, diacarboxylic acid, adipic acid, glutaric acid glyoxal, dihydroxybis(ammonium lactato)titanium(IV) (CAS No. 65104-06-5; Tyzor LA), and glyoxal derivatives, the crosslinking agent preferably being a glyoxal or a glyoxal derivative.

It is preferred in accordance with one aspect of the invention here if the crosslinking has taken place through addition of the crosslinking agent with a mass fraction of 0.05 to 1%, preferably 0.1 to 0.45%, more preferably 0.35 to 0.425%, based on the total mass of all polysaccharides in the first barrier layer.

The carrier substrate, the interlayer, the first barrier layer, and the second barrier layer may also additionally comprise additives that are in common use in papermaking, such as, for example, sizing agents, pigments (besides the pigments already described earlier on above), fluorescent whitening agents, biocides, dispersants, release agents, defoamers, retention aids, fixing aids, flocculants, stock deaerators, wetting agents, flow control agents, mucilage control agents or thickeners. The additives are typically used in order to adjust the properties of the coating compositions used for producing the respective layer (e.g., defoamers or retention aids), or for adjusting the properties of the resultant layer (e.g., fluorescent whitening agents).

Preference is given to a barrier paper of one aspect of the invention wherein

A) the areal density of the paper substrate is 40 to 100 g/m$^2$, preferably 60 to 80 g/m$^2$, more preferably 65 to 75 g/m$^2$, and/or B) the areal density of the interlayer is 2 to 20 g/m$^2$, preferably 5 to 15 g/m$^2$, more preferably 8 to 12 g/m$^2$, and/or C) the areal density of the first barrier layer is 2 to 10 g/m$^2$, preferably 3 to 8 g/m$^2$, more preferably 5 to 6 g/m$^2$, and/or D) the areal density of the second barrier layer is 1 to 20 g/m$^2$, preferably 7 to 15 g/m$^2$, more preferably 9 to 12 g/m$^2$, and/or E) the areal density of the barrier paper is 40 to 120 g/m$^2$, preferably 65 to 100 g/m$^2$, more preferably 80 to 95 g/m$^2$.

Preference is given to a barrier paper of one aspect of the invention wherein the carrier substrate has further layers on the back side. The back side may, for example, have been coated with a starch layer, preferably modified starch, especially preferred modified corn starch. Through a is back-side coating it is possible to improve the properties of the barrier paper. It is possible thereby, for example, to ensure that the back side of the barrier paper is printable.

Preference is given in accordance with one aspect of the invention to a barrier paper which has a water vapor permeability to DIN 53122-1 of less than or equal to 30 g/(m$^2$d), preferably less than or equal to 20 g/(m$^2$d), more preferably of less than or equal to 15 g/(m$^2$d).

Surprisingly it has emerged that the barrier paper of one aspect of the invention exhibits not only a very high fat resistance but also a low water vapor permeability. A low water vapor permeability in the case of packaging is desirable in the case of foods, since the packaged foods do not dry out prematurely and remain fresh for longer.

Preference is given in accordance with one aspect of the invention to a barrier paper wherein the barrier paper has a KIT rating of at least 7, preferably of at least 11, more preferably of at least 12; measured by Tappi method 559.

Our own investigations have shown that barrier papers of the invention can have a KIT rating of more than 12 and that they therefore exhibit an excellent bed resistance, which is within the same range as the fat resistance of barrier papers coated with polymeric or aluminum foil.

It is preferred in accordance with one aspect of the invention if the barrier paper comprises no polymeric or aluminum foils. More particularly it is preferred if the barrier paper of the invention comprises no extruded polymeric films or polymeric foils. It is particularly preferred in accordance with one aspect of the invention if the barrier paper comprises no polymeric foils of polyethylene terephthalate (PET), polyethylene (PE), plasticized polyethylene (LDPE) or polyethylene (PE).

Preference is given in accordance with one aspect of the invention to a barrier paper having a turpentine oil grease permeability to Tappi 454 of at least 1300 s, preferably of at least 1500 s, more preferably of at least 1800 s.

Preference is given in accordance with one aspect of the invention to a barrier paper that has a grease permeability of at least level 5, preferably of at least level 3, more preferably of at least level 1; measured according to the DIN 53116 method.

Preferred in accordance with one aspect of the invention is a barrier paper which has an oxygen permeability to DIN 53880-3 of less than or equal to 90 cm$^3$/(m$^2$d), preferably less than or equal to 70 cm$^3$/(m$^2$d), more preferably of less than or equal to 50 cm$^3$/(m$^2$d).

Preference is given in accordance with one aspect of the invention to a barrier paper which has a hexane vapor permeability at 23° C. and 50% relative humidity of less than or equal to 70 g/(m$^2$d), preferably less than or equal to 60 g/(m$^2$d), more preferably of less than or equal to 50 g/(m$^2$d).

It is preferred in accordance with one aspect of the invention if the barrier paper on the second barrier layer has a Bekk smoothness to ISO 5627 in the range from 10 to 1200 s, provided that the second barrier layer is an outer layer. In this case, in deviation from ISO 5627, the Bekk smoothness is determined not on both sides of the barrier paper, but instead only on the second barrier layer of the barrier paper.

A further aspect of one aspect of the present invention relates to the use of a barrier paper of the invention as wrapping paper, bags, sachets, lining paper, interleaving and/or release paper, preferably for foods, preferably for the wrapping, lining, interleaving and/or separating of bakery products, fried and/or deep-fried products, snack products, sandwiches, bread, burgers, meat products, sausages and/or cheese.

Our own investigations have shown, moreover, that the barrier paper of one aspect of the invention can be used not only in the food sector but also in the nonfood sector. Our own investigations here have shown that a particular possibility is that of the packaging of aromatized articles. Barrier papers of the invention exhibit a high barrier effect with respect to gaseous or vaporized aroma compounds and to aroma oils. Also possible in accordance with one aspect of the invention is the use of a barrier paper of the invention as wrapping paper, bags, sachets, lining paper, interleaving paper and/or release paper for products other than foods, such as, for example, ink cartridges, electronic components or ink pads.

A further aspect of the present invention relates to a method for heat-sealing a barrier paper of the invention, comprising the following steps:

- providing a barrier paper of the invention,
- placing the provided barrier paper of the invention onto a surface, so that at least part of the second barrier layer lies on the surface,
- pressing the barrier paper lying onto the surface with exposure to heat, so that the second barrier layer, at least in the part lying on the surface, is heated to the state of a liquid melt,
- reducing the pressing pressure and the exposure to heat, so that the layer brought into the state of a liquid melt cool.

A further aspect of the present invention relates to a method for producing a barrier paper, preferably a barrier paper of the invention, comprising the following steps:

- providing or producing a carrier substrate comprising a front side and a back side disposed opposite the front side,
- providing or producing an interlayer coating composition, this interlayer coating composition comprising a binder,
- applying the interlayer coating composition to the front side of the substrate,
- drying and/or crosslinking the applied interlayer coating composition, so that an interlayer is formed,
- providing or producing a first barrier coating composition, this first barrier coating composition comprising a polysaccharide and a crosslinking agent and/or a crosslinked polysaccharide,
- applying the first barrier coating composition to the interlayer,
- drying and/or crosslinking the applied first barrier coating composition, so that a first barrier layer is formed,
- providing or producing a second barrier coating composition, consisting of or comprising
  - i) an acrylate copolymer
  - and/or
  - ii) a wax based on a vegetable oil - applying the second barrier coating composition to the first barrier layer,
- applying the second barrier coating composition to the first barrier layer,
- drying and/or crosslinking the applied second barrier coating composition, so that a second barrier layer is formed.

In the context of one aspect of the present invention, preferably two or more of the aspects identified above as being preferred are implemented simultaneously; especially preferred are those combinations of such aspects, and of the corresponding features, that are apparent from the appended claims.

With regard to the coating composition used in a method of one aspect of the invention for producing a barrier paper, reference may be made here to the observations relating to the composition of the individual layers. These coating compositions are designed so as to result in the layers that are present in a barrier paper of the invention. Typically the coating compositions here take the form of an aqueous dispersion and comprise the constituents or compounds (e.g., monomers or crosslinking agents) that react to form the constituents that are present in the individual layers.

Additionally, the coating compositions may also comprise additives commonly used in papermaking, such as biocides, dispersants, release agents, defoamers or thickeners, for example, which are added in order to establish the properties of the coating composition and which typically remain in the layer produced from the coating composition. In this regard, additives typically used in papermaking may be employed in the customary amounts.

For applying the coating composition to the carrier substrate or to a layer already present on the carrier substrate (e.g., interlayer or first barrier layer), the skilled person is aware of various technologies which are referred to as coating, examples including the following: blade coating, coating by film press, cast coating, curtain coating, knife coating, airbrush coating or spray coating. All of these aforesaid known techniques of coating are suitable for applying the coating composition of the invention to a carrier substrate, preferably a paper substrate which comprises one or more priming coats and/or tie coats, or else which comprises no priming or tie coat. Preference in accordance with one aspect of the invention is given to curtain coating.

The barrier paper of the invention is preferably at least biodegradable.

Biodegradability is defined such that a material can be degraded biologically under anaerobic or aerobic conditions and accordingly in this process, depending on environmental conditions, $CO_2$, $H_2O$, methane, biomass, and mineral salts are released. An important part here is played by naturally occurring microorganisms which feed primarily on organic waste.

The barrier paper of the invention is preferably compostable.

Composting describes the process of breakdown of organic wastes via microbial digestion in order to produce compost. Compost has a multitude of benefits, for improving and fertilizing the soil, for example. For the composting process, the organic waste requires the right temperature and the right degree of water and oxygen. In a heap of organic waste, there are millions of tiny microbes which cause it to pass through their digestion system and so convert the organic materials into compost.

Both specifications require a biodegradable/compostable barrier paper to be broken down completely, within a specified time frame and without leaving residues harmful to the environment.

With particular preference, the barrier paper of one aspect of the invention is recyclable.

The recycling of residual materials is understood as a recirculation of matter that is used in production or consumption.

Aspects of invention are further elucidated below by examples.

EXAMPLES

Example 1

The carrier substrate used was a paper substrate produced from a 1:1 mixture of short-fiber and long-fiber pulps with a freeness of 39° SR and an addition of talc as filler with a mass fraction of 1%, based on the total mass of the paper substrate, on a paper machine, in the form of a paper web, provided with resin sizing in the stock, having a mass per unit area of 70 g/m$^2$. The paper substrate produced was calendared under a linear load of 80 kN/m and a temperature of 80° C.

Using a nozzle applicator and a coating knife, an interlayer coating composition in the form of an aqueous dispersion was applied to the front side, and this coating composition was subsequently dried by means of IR, air drying, and drying cylinders, to result in an interlayer having an areal density of 10 g/m$^2$. The composition of the interlayer coating composition (disregarding water) is indicated in Table 1.

Using an airbrush, a first barrier coating composition in the form of an aqueous dispersion was applied to the interlayer produced, and this coating composition was subsequently dried using IR and air drying to result in a first barrier layer having an areal density of 5.5 g/m$^2$. The composition of the first barrier coating composition (disregarding water) is indicated in Table 1.

Using a volumetric coating knife, a second barrier coating composition in the form of an aqueous dispersion was applied to the first barrier layer produced, and this coating composition was subsequently dried using IR and air drying to result in a second barrier layer having an areal density of 9.5 g/m$^2$. The composition of the second barrier coating composition (disregarding water) is indicated in Table 1.

The resulting barrier paper, which was heat-sealable at 120° C., had an areal density of 95 g/m$^2$ and was measured to ascertain its properties. The results are summarized in Table 2.

TABLE 1

| Constituent | Trade name | Component | Mass fraction |
|---|---|---|---|
| Interlayer coating composition (plus water): | | | |
| Kaolin | Capim NP Slurry | Pigment | 70% |
| | Agitan 351 | Defoamer | 0.24% |
| Mixture of 5-chloro-2-methyl-2H-isothiazol-3-one and 5-methyl-2H-isothiazol-3-one | Acroflex 307 | | 0.61% |
| | Acronal 505 | Binder | 29.15% |
| First barrier coating composition (plus water): | | | |
| | Metolat 700 | Wetting agent | 0.35% |
| Glyoxal | Glyoxal | Crosslinking agent | 0.42% |
| Xylan | XH 11.4 (from Seelution AB) | Barrier agent | 99.23% |
| Second barrier coating composition (plus water): | | | |
| Acrylate copolymer | Tecryl PB 16/3 (Trüb Emulsions Chemie) | Barrier agent | 99.575% |
| | Metolat 700 | Wetting agent | 0.25% |
| | Sterocoll BL | Thickener | 0.175% |

TABLE 2

| | Value | Method of determination |
|---|---|---|
| Water vapor permeability: | 13.4 g/(m$^2$ * day) | DIN 53122-1 |
| KIT rating: | 12 | Tappi 559 |
| Fat permeability test with palm kernel fat: | Level 1 | DIN 53116 |

TABLE 2-continued

| | Value | Method of determination |
|---|---|---|
| Fat permeability test with turpentine oil: | +1800 s | Tappi 454 |
| Bekk smoothness: | 15 s | ISO 5627 |

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A barrier paper that is heat-sealable comprising:

a) a carrier substrate having a front side and a back side opposite the front side;

b) a first barrier layer comprising a crosslinked polysaccharide, wherein the crosslinked polysaccharide comprises a crosslinked xylan, and the first barrier layer is disposed on:

the front side of the carrier substrate or an interlayer disposed on the front side of the carrier substrate and comprising a binder;

c) a second barrier layer, disposed on the first barrier layer comprising at least one of:

i) an acrylate copolymer and ii) a wax based on a vegetable oil.

2. The barrier paper as claimed in claim 1, wherein the crosslinked polysaccharide is one or more of:

a crosslinked xylan, a crosslinked arabinoxylan, and comprises a crosslinked arabinoxylan.

3. The barrier paper as claimed in claim 1, wherein the second barrier layer comprises an:

i) the acrylate copolymer; and ii) the wax based on a vegetable oil.

4. The barrier paper as claimed in claim 1, wherein the second barrier layer comprises the acrylate copolymer and a wax based on saturated hydrocarbons.

5. The barrier paper as claimed in claim 4, wherein the wax based on saturated hydrocarbons comprises one or more alkanes selected from the group consisting of heneicosane, docosane, tricosane, tetracosane, pentacosane, hexacosane, heptacosane, octacosane, nonacosane, triacontane, hentriacontane, dotriacontane, tritriacontane, tetratriacontane, pentatriacontane, hexatriacontane, heptatriacontane, octatriacontane, and nonatriacontane, preferably selected from the group consisting of hexacosane, heptacosane, octacosane, nonacosane, and triacontane.

6. The barrier paper as claimed in claim 4, wherein the wax based on saturated hydrocarbons is octacosane.

7. The barrier paper as claimed in claim 1, wherein the second barrier layer comprises an i) the acrylate copolymer, ii) the wax based on a vegetable oil, and iii) a wax based on saturated hydrocarbons.

8. The barrier paper as claimed in claim 7, wherein the wax based on a vegetable oil is a wax based on an oil selected from the list consisting of palm oil, coconut oil, poppyseed oil, olive oil, linseed oil, soybean oil, sunflower oil, safflower oil, and rapeseed oil.

9. The barrier paper as claimed in claim 7, wherein the wax based on a vegetable oil is a wax based on soybean oil.

10. The barrier paper as claimed in claim 1, wherein the carrier substrate comprises a pulp having a Schopper-Riegler freeness in a range
from 24 to 54° SR.

11. The barrier paper as claimed in claim 1, wherein the barrier paper has a KIT rating measured by Tappi method 559 of at least 7.

12. The barrier paper as claimed in claim 1, wherein at least one of:
A) an areal density of the carrier substrate is 40 to 100 $g/m^2$,
and/or
B) an areal density of the interlayer is 2 to 20 $g/m^2$,
and/or
C) an areal density of the first barrier layer is 2 to 10 $g/m^2$,
and/or
D) an areal density of the second barrier layer is 1 to 20 $g/m^2$,
and/or
E) an areal density of the barrier paper is 40 to 120 $g/m^2$.

13. The barrier paper as claimed in claim 1, wherein the interlayer further comprises a pigment, configured as one of an inorganic pigment, and the pigment selected from the group consisting of natural or calcined aluminum silicate, natural or calcined kaolinite or natural or calcined kaolin, hydrated magnesium silicate, talc, aluminum hydroxide, boehmite, bentonite, calcium carbonate, silicon dioxide, and silica.

14. The barrier paper as claimed in claim 1, wherein the binder in the interlayer is at least one of: starch, a synthetic polymer, styrene-butadiene latex, polyvinyl alcohol, carboxyl group-modified polyvinyl alcohol, ethylene-vinyl alcohol copolymer, silanol group-modified polyvinyl alcohol, acetoacetyl modified polyvinyl alcohol, diacetone-modified polyvinyl alcohol, acrylate copolymer, and film-forming acrylic copolymer.

15. The barrier paper as claimed in claim 1, wherein the carrier substrate is one of paper, cardboard, and paperboard substrate.

16. The barrier paper as claimed in claim 1, wherein the second barrier layer further comprises at least one of an acrylic acid-acrylamide copolymer and a sodium salt thereof.

17. The barrier paper as claimed in claim 16, wherein a mass fraction of acrylic acid-acrylamide copolymer based on a solids content of the second barrier layer is 0.1 to 1.0%.

18. The barrier paper as claimed in claim 1, wherein the barrier paper is one of a wrapping paper, a bag, a sachet, lining paper, interleaving and/or release paper for products, wrapping, lining, interleaving and/or separating one or more of bakery products, fried and/or deep-fried products, snack products, sandwiches, bread, burgers, meat products, sausages, and cheese.

19. A method of heat sealing of a heat-sealable barrier paper comprising:
a) a carrier substrate having a front side and a back side opposite the front side;
b) a first barrier layer comprising a crosslinked polysaccharide, wherein the crosslinked polysaccharide comprises a crosslinked xylan, and the first barrier layer is disposed on:
the front side of the carrier substrate or
an interlayer disposed on the front side of the carrier substrate and comprising a binder;
c) a second barrier layer, disposed on the first barrier layer comprising:
i) an acrylate copolymer
and/or
ii) a wax based on a vegetable oil,
the method comprising:
providing the heat-sealable barrier paper;
placing the heat-sealable barrier paper onto a surface, so that at least part of the second barrier layer lies on the surface;
pressing the heat-sealable barrier paper lying onto the surface with exposure to heat, so that the second barrier layer, at least in the part lying on the surface, is heated to a state of a liquid melt; and
reducing the pressing pressure and the exposure to heat, so that the layer brought into the state of a liquid melt cools.

20. A method for producing a barrier paper, comprising:
providing or producing a paper substrate comprising a front side and a back side disposed opposite the front side,
providing or producing an interlayer coating composition, this interlayer coating composition comprising a binder,
applying the interlayer coating composition to the front side of the paper substrate,
drying and/or crosslinking the applied interlayer coating composition, so that an interlayer is formed,
providing or producing a first barrier coating composition, the first barrier coating composition comprising a polysaccharide and a crosslinking agent and/or a crosslinked polysaccharide, wherein the crosslinked polysaccharide comprises a crosslinked xylan,
applying the first barrier coating composition to the interlayer,
drying and/or crosslinking the applied first barrier coating composition, so that a first barrier layer is formed,
providing or producing a second barrier coating composition, consisting of or comprising
i) an acrylate copolymer
and/or
ii) a wax based on a vegetable oil
applying the second barrier coating composition to the first barrier layer; and
drying and/or crosslinking the applied second barrier coating composition, so that a second barrier layer is formed.

* * * * *